US011299973B2

(12) United States Patent
Brown et al.

(10) Patent No.: US 11,299,973 B2
(45) Date of Patent: Apr. 12, 2022

(54) GAS SEPARATOR WITH FLUID RESERVOIR AND SELF-ORIENTATING INTAKE

(71) Applicant: Halliburton Energy Services, Inc., Houston, TX (US)

(72) Inventors: Donn J. Brown, Broken Arrow, OK (US); Randy S. Roberts, Tulsa, OK (US); Larry J. Parmeter, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 356 days.

(21) Appl. No.: 16/476,816

(22) PCT Filed: Oct. 5, 2018

(86) PCT No.: PCT/US2018/054703
§ 371 (c)(1),
(2) Date: Jul. 9, 2019

(87) PCT Pub. No.: WO2020/072078
PCT Pub. Date: Apr. 9, 2020

(65) Prior Publication Data
US 2021/0332688 A1 Oct. 28, 2021

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01)

(58) Field of Classification Search
CPC ..... E21B 43/38; E21B 43/128; E21B 43/35; E21B 43/34; E21B 43/13
See application file for complete search history.

(56) References Cited

U.S. PATENT DOCUMENTS 5,588,486 A 12/1996 Heinrichs
6,715,556 B2 * 4/2004 Mack ..... E21B 43/121 166/105

(Continued)

FOREIGN PATENT DOCUMENTS

WO 2018164962 A1 9/2018

OTHER PUBLICATIONS

International Search Report and Written Opinion dated Jul. 4, 2019; International PCT Application No. PCT/US2018/054703.

*Primary Examiner* — Michael R Wills, III
(74) *Attorney, Agent, or Firm* — McGuireWoods LLP

(57) ABSTRACT

A gas separator operationally coupled between a submersible pump and a motor for use in downhole reservoirs includes an intake housing and an inner intake assembly. The intake housing includes at least two sets of intake ports along an upper section adjacent to the pump with ports in a set vertically offset and sets horizontally offset. The inner intake assembly includes a separation chamber, a self-orienting intake rotatable around a central axis and having at least one communication port, and a port controller. The port controller functions to position the communications port toward the bottom of the gas separator when the gas separator is positioned horizontally in a downhole wellbore. The intake housing allows reservoir fluid traveling downstream to pass through intake ports and into the separation chamber through the communication ports.

20 Claims, 4 Drawing Sheets

(56) References Cited

U.S. PATENT DOCUMENTS

| | | | | |
|---|---|---|---|---|
| 7,270,178 | B2 * | 9/2007 | Selph | E21B 43/128 166/105.5 |
| 7,798,211 | B2 * | 9/2010 | Brown | E21B 43/128 166/105.5 |
| 7,921,908 | B2 * | 4/2011 | Tetzlaff | E21B 43/38 166/108 |
| 7,980,314 | B2 * | 7/2011 | Mack | E21B 34/06 166/369 |
| 9,494,022 | B2 * | 11/2016 | Coates | E21B 43/128 |
| 2001/0004017 | A1 | 6/2001 | Lopes | |
| 2003/0111230 | A1 | 6/2003 | Olson et al. | |
| 2014/0105755 | A1 * | 4/2014 | Bookout | F04C 14/28 417/15 |
| 2014/0369868 | A1 * | 12/2014 | Tetzlaff | F04D 9/001 417/423.3 |
| 2015/0204169 | A1 | 7/2015 | Coates et al. | |
| 2016/0281486 | A1 * | 9/2016 | Obrejanu | B01D 21/2494 |
| 2017/0138167 | A1 | 5/2017 | Wang et al. | |
| 2019/0309768 | A1 * | 10/2019 | Todd | F04D 29/426 |
| 2020/0308940 | A1 * | 10/2020 | Hill | E21B 43/121 |

* cited by examiner

GAS SEPARATOR WITH FLUID RESERVOIR AND SELF-ORIENTATING INTAKE

BACKGROUND

The present disclosure relates, in general, to the downhole application of artificial lift systems to access a well reservoir and, in particular, to a gas separator of an Electrical Submersible Pump (ESP) string that includes a reservoir and an upper intake port and a lower self-orienting intake port for drawing liquid from a reservoir.

The oil and gas industry develops well sites by creating wellbores and using ESP strings to access and lift liquid from downhole reservoirs. As drilling technology has advanced, well site developers have become better able to access reservoirs from different angles and locations. It is not necessary to drill straight down but rather angular landings can be developed to create a pathway to a reservoir which may otherwise be very difficult to access. As such, well site developers can develop wellbores with varying angular configurations and undulations. Because these reservoirs often include deposits of liquid and gas, the gas tends to build up in higher elevations of the well bore undulations until it is forced downstream by fluids (gas and liquid) entering upstream from the formation. These discharges of gas concentrations move through the well bore more in the form of a gas slug rather than small bubbles. Centrifugal pumps are designed to move liquid so gas has a detrimental effect on their performance. Therefore it is desirable to separate the liquid from the gas during the liquid extraction process. The ESP string can include a pump, a gas separator, seal or protector, and a motor. The gas separator operates upstream of the pump to separate the gas from the liquid. Due to Earth's gravity, the gas separator can function significantly different depending on the configuration of the wellbore. As drilling technologies have evolved and enabled well site developers to develop wellbores having many different configurations, gas separators must also evolve to effectively process fluid in these various configurations.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1A:
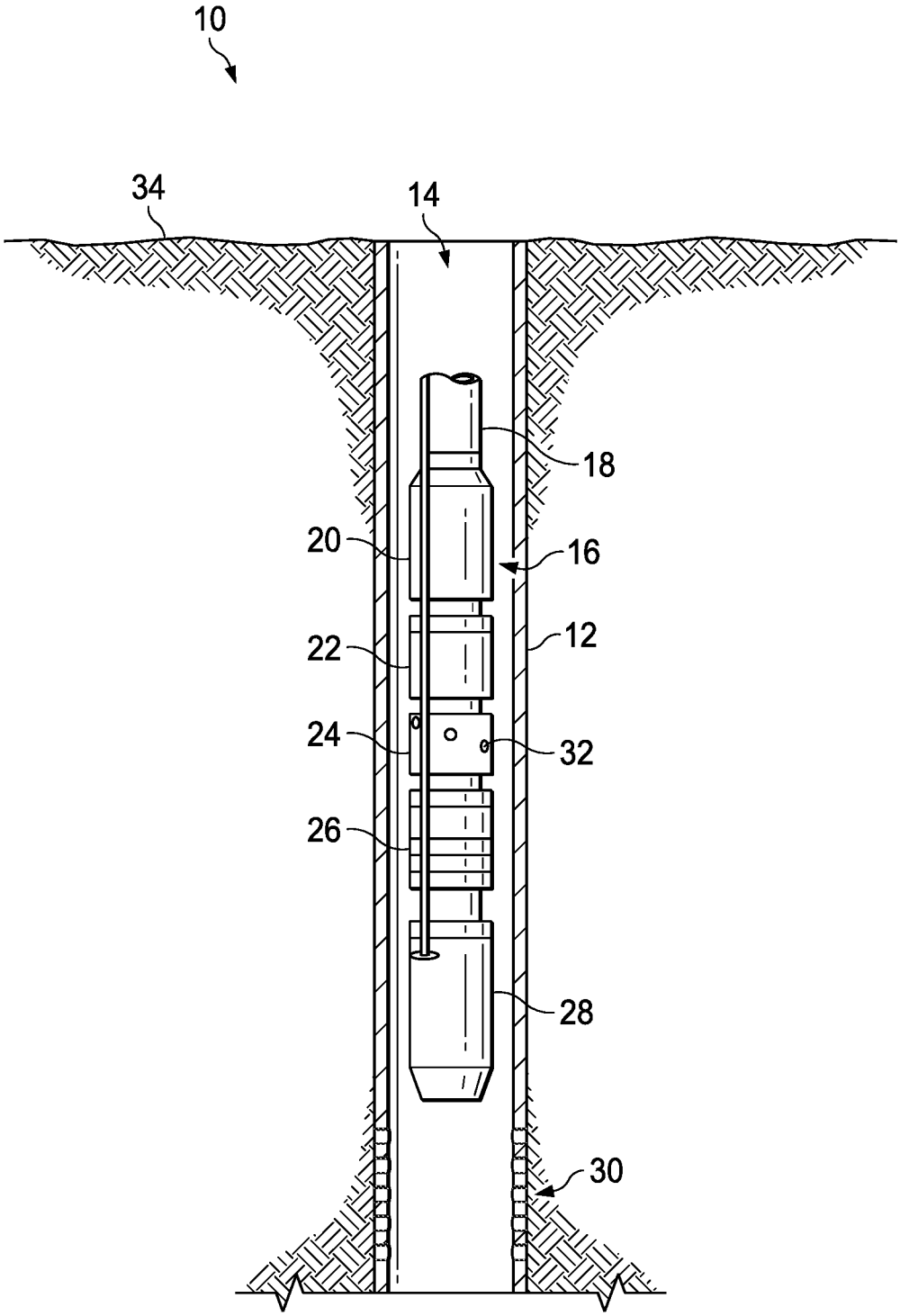
FIG. 1A is an illustration of a wellbore and ESP string configuration, according to certain example embodiments.

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

As used in this specification and the appended claims, the singular forms "a", "an" and the "the" include plural referents unless the context clearly dictates otherwise. Thus, for example reference to an "opening" includes one or more openings.

"Coupled" refers to either a direct connection or an indirect connection (e.g., at least one intervening connection) between one or more objects or components. The phrase "directly attached" means a direct connection between objects or components.

As used herein, the term "outer," "outside" or "outward" means the radial direction away from the center of the shaft of an ESP assembly element such as a gas separator and/or the opening of a component through which the shaft would extend.

As used herein, the term "inner", "inside" or "inward" means the radial direction toward the center of the shaft of an ESP assembly element such as a gas separator and/or the opening of a component through which the shaft would extend.

As used herein the terms "axial", "axially", "longitudinal" and "longitudinally" refer interchangeably to the direction extending along the length of the shaft of an ESP assembly component such as an ESP intake, multi-stage centrifugal pump, seal section, gas separator or charge pump.

"Downstream" refers to the direction substantially with the principal flow of working fluid when the pump assembly is in operation. By way of example but not limitation, in a vertical downhole ESP assembly, the downstream direction may be towards the surface of the well. The "top" of an element refers to the downstream-most side of the element.

"Upstream" refers to the direction substantially opposite the principal flow of working fluid when the pump assembly is in operation. By way of example but not limitation, in a vertical downhole ESP assembly, the upstream direction may be opposite the surface of the well. The "bottom" of an element refers to the upstream-most side of the element.

Fluid, such as gas, oil or water, is harvested from in underground formations by the oil and gas industry. Centrifugal pumps are typically used in electric submersible pump (ESP) applications for lifting well fluid to the surface for processing and distribution. Centrifugal pumps lift the fluid by accelerating the fluid through a rotating impeller paired with a stationary diffuser, together referred to as a "stage." Multistage centrifugal pumps use several stages of impeller and diffuser pairs to further increase the pressure lift.

Efficient, effective, and economical ESP operation can be a challenge when pumping gas laden fluid. The gas can separate from the other fluid due to the pressure differential created when the pump is in operation. If there is a sufficiently high gas volume fraction (GVF), typically around 10% to 15%, the pump can experience a decrease in efficiency and decrease in capacity or head (slipping). If gas continues to accumulate on the suction side of the impeller it can block the passage of the oil through the centrifugal pump. If this occurs the pump is said to be "gas locked" since the accumulation of gas impedes operation of the pump.

Conventional ESPs often include a gas separator ached below the centrifugal pump in an attempt to separate gas out of the multi-phase fluid before the gas reaches the pump. Common types of gas separator are reverse flow or static (where the device takes advantage of the gravitational forces of the liquid verses the buoyancy of the gas with flow direction), and mechanical vortex type or rotary type separators (where the fluids are energized mechanically to centrifugally separate the fluids). As previously discussed, the ESP string may operate in a wellbore having a traditional vertical configuration but may also operate in a wellbore having different angular landing configurations. Regardless of the wellbore configuration and string orientation, the gas separator needs to manage all fluid phases drawn from the reservoir so as optimize production and minimize "gas lock."

Figure 1B:
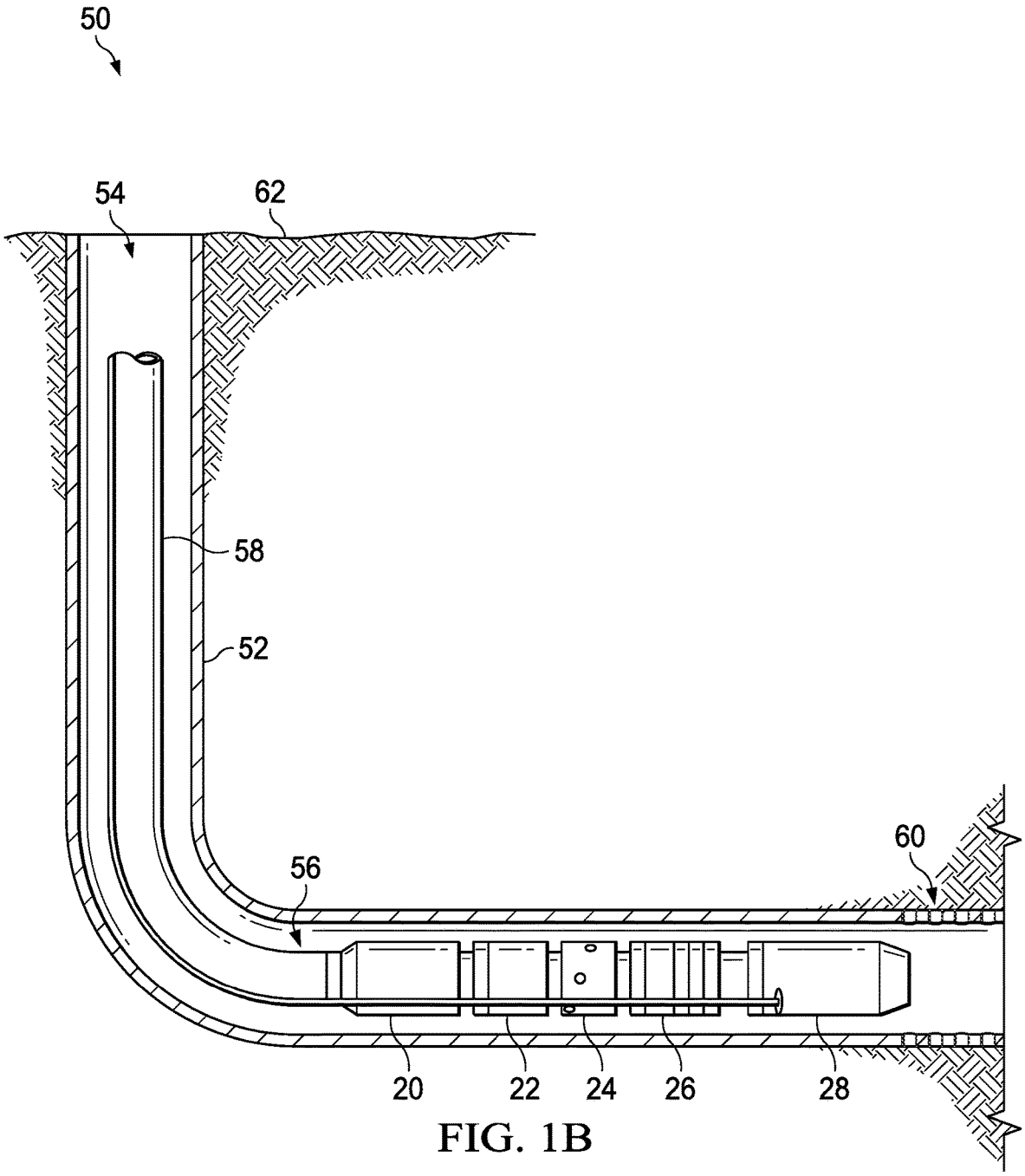
FIG. 1B is an illustration of another wellbore and ESP string configuration, in accordance with certain example embodiments.

Referring now to FIGS. 1A and 1B, illustrated are wellbore and ESP string configurations, according to certain example embodiments, denoted generally as 10 and 50, respectively. In each configuration presented, the phases of the fluid may be a mix of liquid and gas or pockets of one or the other. The design of the ESP string's separator presented herein uses a combination of a separator chamber reservoir as in a reverse flow separator and a self-orienting inner chamber intake that provides a reserve reservoir for liquid from the well reservoir and Earth's gravity as a separator in horizontal, vertical, and transitional configurations.

Configuration 10 illustrates a wellbore casing 12, a casing annulus 14, and an ESP string 16 in a straight vertical configuration. ESP string 16 includes production tubing 18, ESP pump 20, charge pump 22, gas separator 24, seal section 26, and motor 28. The ESP string 16 functions to draw reservoir fluid through perforations 30 in the wellbore casing 12 and into a set of downstream, vertically offset intake ports 32 formed along the upper section of the gas separator 24 for separation processing and lifting of reservoir liquid to the well surface 34.

Configuration 50 illustrates a wellbore casing 52, a casing annulus 54, and an ESP string 56 in a vertical and horizontal configuration with the ESP string 56 positioned on a horizontal landing. Although, the ESP string 56 could be positioned on the landing defining the transition between the vertical and horizontal landing. ESP string 56 includes production tubing 58, ESP pump 20, charge pump 22, gas separator 24, seal section 26, and motor 28. The ESP string 56 functions to draw reservoir fluid through perforations 60 in the wellbore casing 52 and into a set of downstream intake ports 32 that are vertically offset. The downstream intake ports are formed along the upper section of the gas separator 24 for separation processing and lifting of reservoir liquid to the well surface 34.

The set of downstream intake ports 32 can traverse the upper housing of the separator 24 vertically or vertically and diagonally and can include multiple sets surrounding the circumference of the upper section of the separator 24. Vertically as defined herein means downstream to upstream. Furthermore, when referencing upper and lower ports, upper ports are defined as ports nearer to the section of the separator that couples with the charge pump 22. When referencing top side and bottom side intake ports, top side intake ports are ports facing the surface 62 of the well in a horizontal configuration.

In a vertical configuration, reservoir fluid can enter the lower intake ports. The low density, gas rich fluid can continue traveling downstream and easily exit out the upper intake ports of the set of vertically offset intake ports 32 and the high density, gas poor fluid can travel back upstream into the housing of the separator 24. In a horizontal configuration, the reservoir fluid can enter through the lower and bottom side intake ports. The more dense liquid can drop to the bottom of the separator housing and the less dense gas rises up to exit through the top sided ports of the separator housing. Regardless of configuration, the port offset configuration uses Earth's gravity to separate the low density, gas rich fluid from the high density, gas poor fluid.

Referring now to dig 2A, illustrated is a cross-sectional view of gas separator 24 for use with ESP string 16 and 56, according to certain example embodiments. The gas separator 24 includes housing 82, an inner intake assembly comprising a separation chamber 84 and a self-orienting intake 86, a shaft 88, an auger 90 (or impeller and/or stage) and spider bearings 92 keyed to the shaft, and a spider support 93 between outer chamber 94 and inner chamber 95. The gas separator 24 can be coupled to the pump 20 and the motor 28 through the charge pump 22 and the seal section 26. Shaft 88 can be rotated by motor 28 and extend longitudinally and centrally through gas separator 24. The Auger 90 can impart axial momentum to liquid travelling through the separation chamber 84. The housing 82 can include downstream intake ports 32 that are vertically offset or vertically offset and staggered. The downstream intake ports 32 are near the top of the gas separator 24 where the separator and pump interface. The intake ports 32 provide a reverse path into an outer chamber 94 for reservoir fluid traveling downstream up the casing annulus 14 and a forward path for gas discharging from the separator 24. Regardless of the ESP string configuration, the gas separator 24 functions to immediately separate the low density, gas rich fluid from the high density, gas poor fluid. The high density, gas poor fluid can flow upstream into communication ports 96 of the self-orienting intake 86.

Figure 2A:
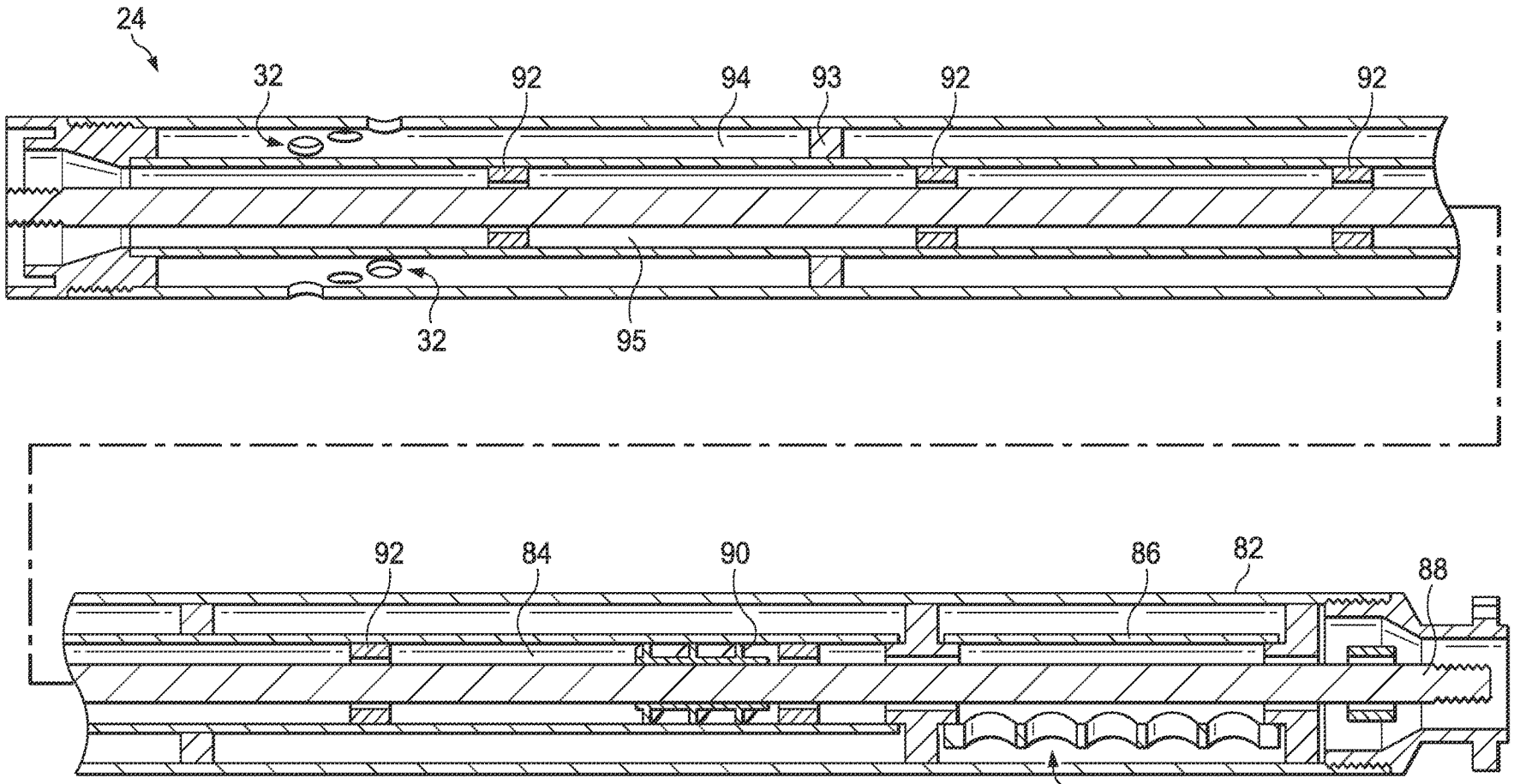
FIG. 2A is an illustration of a cross-sectional view of a gas separator for use with the ESP string configurations, in accordance with certain example embodiments.
Figure 2B:
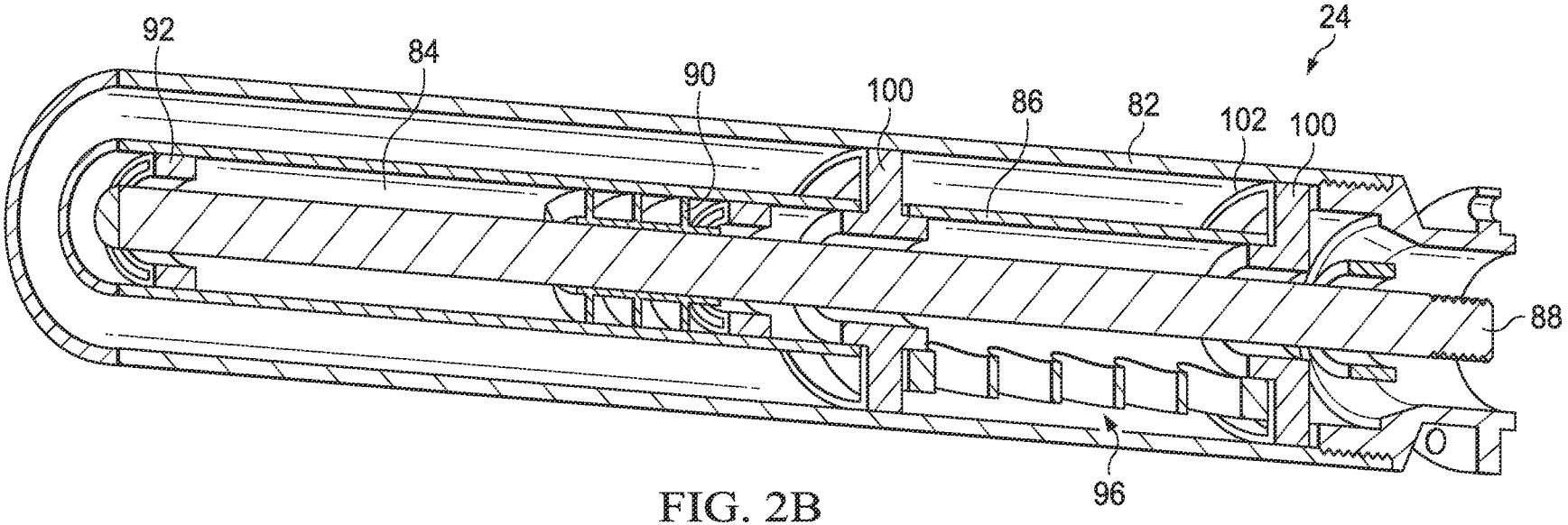
FIG. 2B is an illustration of another cross-sectional view of the gas separator for use with ESP string configurations, according to certain example embodiments.
Figure 2C:
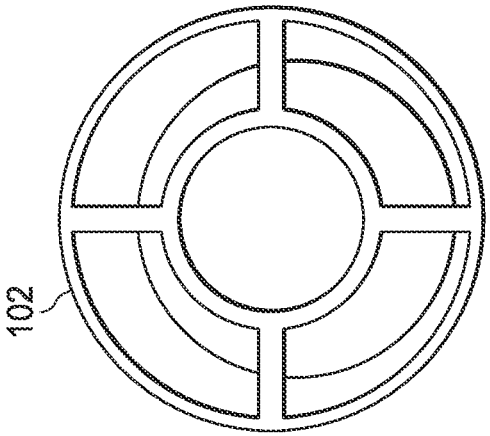
FIG. 2C is an illustration of a gas separator counterweight, according to certain example embodiments.

Referring now to FIG. 2B, illustrated is another cross-sectional view of gas separator 24 for use with ESP string 16 and 56, according to certain example embodiments. The self-orienting intake 86 is rotatable about a center axis. The self-orienting intake 86 also rotates around dividers 100 that include a guide or flange for supporting rotation. The self-orienting intake 86 further includes a counterweight 102, see FIG. 2C, that functions to position self-orienting intake 86 so that the communication ports 96 are on the bottom side, facing opposite the surface 62, of the separator 24 when the ESP string 56 is in the horizontal configuration. The counterweight 102 includes a weighted section that extends eccentrically from a center ring to an outer ring providing the self-orienting intake 86 with a weight imbalance. The alignment of the weighted section with the communication ports 96 allows control of the position of the ports. Regardless of whether the configuration is horizontal or vertical, the communication ports 96 allow high density, gas poor fluid to enter and fill the separation chamber 84.

The separation chamber 84 provides a reserve reservoir of liquid when a gas slug goes by the intake ports 32 in vertical to horizontal landings. In more horizontal applications, the communication ports 96 of the self-orienting inner intake 86 assures fluid communication from the outer chamber 94 to the separation chamber 84 from the lowest area of the outer chamber 94 where the heavier fluid (liquid) is located. Within the separation chamber 84 one or more energized fluid moving devices connected to the drive shaft can be used to create a lower pressure to create a path for the liquid. As depicted above, the inner intake self-orientates in horizontal landings by eccentric design, free to rotate on a centralized axis which positions the communication port inlets at the lowest point of the outer chamber where the highest concentration of liquid is found.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a gas separator operationally coupled between a submersible pump and a motor for use in downhole reservoirs, the gas separator comprising: an intake housing that includes at least two sets of intake ports along an upper section adjacent to the pump with ports in a set vertically offset and sets horizontally offset; and an inner intake assembly having a separation chamber and at least one communication port; wherein operation of the submersible pump causes reservoir liquid to flow through the at least one intake port and into the separation chamber through the at least one communication port.

Clause 2, the gas separator of clause 1, wherein ports in a set are vertically offset and/or staggered.

Clause 3, the gas separator of clause 1, wherein the inner intake assembly is rotatable about a center axis and includes the at least one communication port for allowing reservoir fluid to pass into the reservoir chamber.

Clause 4, the gas separator of clause 1, wherein the at least one communication port is adjacent to the motor seal.

Clause 5, the gas separator of clause 1, wherein the inner intake assembly further comprises self-orienting intake wherein the self-orienting intake is rotatable about a center axis and includes the at least one communication port for allowing reservoir fluid to pass into the separation chamber.

Clause 6, the gas separator of clause 5, wherein the self-orienting intake is positioned in the intake housing adjacent to the motor seal.

Clause 7, the gas separator of clause 5, wherein the inner intake assembly further comprises: a divider having a first side and a second side having a guide, the separation chamber coupled to the first side and the self-orienting intake rotatable around the guide of the second side; a port position controller that controls the position of the at least one communication port depending on the orientation of the gas separator.

Clause 8, the gas separator of clause 7, wherein the port position controller is a counterweight that functions to position the at least one communication port facing toward the bottom of the gas separator when the gas separator is positioned horizontally in a downhole wellbore.

Clause 9, a gas separator operationally coupled between a submersible pump and a motor for use in downhole reservoirs, the gas separator comprising: an intake housing that includes at least two sets of intake ports along an upper section adjacent to the pump with ports in a set vertically offset and sets horizontally offset; and an inner intake assembly having a separation chamber and at least one communication port and a port position controller; wherein the port position controller is a counterweight that functions to position the at least one communication port facing toward the bottom of the gas separator when the gas separator is positioned horizontally in a downhole reservoir; wherein operation of the submersible pump causes reservoir liquid to flow through the at least one intake port and into the reservoir chamber through the at least one communication port.

Clause 10, the gas separator of claim 9, wherein ports in a set are vertically offset and or staggered.

Clause 11, the gas separator of clause 9, wherein the inner intake assembly is rotatable about a center axis and includes the at least one communication port for allowing reservoir fluid to pass into the separation chamber.

Clause 12, the gas separator of clause 9, wherein the at least one communication port is at a position in the intake housing adjacent to the motor.

Clause 13, the gas separator of clause 9, wherein the inner intake assembly further comprises a self-orienting intake wherein the self-orienting intake is rotatable about a center axis and includes the at least one communication port for allowing reservoir fluid to pass into the separation chamber.

Clause 14, the gas separator of clause 13, wherein the lower section is positioned in the intake housing adjacent to the motor.

Clause 15, the gas separator of clause 13, wherein the inner intake assembly further comprises: a divider having a first side and a second side having a guide, the separation chamber coupled to the first side and the self-orienting intake rotatable around the guide of the second side.

Clause 16, a fluid separator operationally coupled between a submersible pump and a motor for use in downhole reservoirs, the fluid separator comprising: an intake housing that includes at least two sets of intake ports along an upper section adjacent to the pump with ports in a set vertically offset and sets horizontally offset; and an inner intake assembly having a separation chamber and a rotatable section communicable coupled with the reservoir chamber, wherein the rotatable section includes at least one communication port; wherein operation of the submersible pump causes reservoir liquid to flow through the at least one intake port and into the reservoir chamber through the at least one communication port.

Clause 17, the fluid separator of clause 16, wherein ports in a set are vertically offset and staggered.

Clause 18, the fluid separator of clause 16, wherein the rotatable section is positioned in the intake housing adjacent to the motor.

Clause 19, the fluid separator of clause 16, wherein the inner intake assembly further comprises: a divider having a first side and a second side having a guide, the separation chamber coupled to the first side and the rotatable section rotatable about the guide of the second side; and a port position controller that controls the position of the at least one communication port depending on the orientation of the gas separator.

Clause 20, the fluid separator of clause 16, wherein the port position controller is a counterweight that functions to position the at least one communication port facing toward the bottom of the gas separator when the gas separator is positioned horizontally in a downhole reservoir.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. A gas separator operationally coupled between a submersible pump and a motor for use in downhole reservoirs, the gas separator comprising:

an intake housing that includes at least two sets of intake ports along an upper section adjacent to the pump with ports in a set vertically offset and sets horizontally offset; and an inner intake assembly having a separation chamber and at least one communication port, wherein the inner intake assembly further comprises a self-orienting intake wherein the self-orienting intake is rotatable about a center axis and includes the at least one communication port for allowing reservoir fluid to pass into the separation chamber, wherein the inner intake assembly further comprises: a divider having a first side and a second side having a guide, the separation chamber coupled to the first side and the self-orienting intake rotatable around the guide of the second side, and a port position controller that controls the position of the at least one communication port depending on the orientation of the gas separator;

wherein operation of the submersible pump causes reservoir liquid to flow through the at least one intake port and into the separation chamber through the at least one communication port.

2. The gas separator of claim 1 wherein ports in a set are vertically offset and staggered.

3. The gas separator of claim 1 wherein the at least one communication port is adjacent to the motor.

4. The gas separator of claim 1 wherein the self-orienting intake is positioned in the intake housing adjacent to the motor.

5. The gas separator of claim 1 wherein the port position controller is a counterweight that functions to position the at least one communication port facing toward the bottom of the gas separator when the gas separator is positioned horizontally in a downhole wellbore.

6. The gas separator of claim 1 further comprising a shaft rotated by the motor.

7. The gas separator of claim 6 further comprising spider bearings keyed to the shaft.

8. The gas separator of claim 1 further comprising an augur.

9. A gas separator operationally coupled between a submersible pump and a motor for use in downhole reservoirs, the gas separator comprising:

an intake housing that includes at least two sets of intake ports along an upper section adjacent to the pump with ports in a set vertically offset and sets horizontally offset; and an inner intake assembly having a separation chamber and at least one communication port and a port position controller, wherein the inner intake assembly further comprises a self-orienting intake wherein the self-orienting intake is rotatable about a center axis and includes the at least one communication port for allowing reservoir fluid to pass into the separation chamber, and wherein the inner intake assembly further comprises a divider having a first side and a second side having a guide the separation chamber coupled to the first side and the self-orienting intake rotatable around the guide of the second side;

wherein the port position controller is a counterweight that functions to position the at least one communication port facing toward the bottom of the gas separator when the gas separator is positioned horizontally in a downhole reservoir;

wherein operation of the submersible pump causes reservoir liquid to flow through the at least one intake port and into the separation chamber through the at least one communication port.

10. The gas separator of claim 9 wherein ports in a set are vertically offset and staggered.

11. The gas separator of claim 9 wherein the at least one communication port is at a position in the intake housing adjacent to the motor.

12. The gas separator of claim 9 wherein the self-orienting intake is positioned in the intake housing adjacent to the motor.

13. The gas separator of claim 9 further comprising a shaft rotated by the motor.

14. The gas separator of claim 13 further comprising spider bearings keyed to the shaft.

15. A fluid separator operationally coupled between a submersible pump and a motor for use in downhole reservoirs, the fluid separator comprising:

an intake housing that includes at least two sets of intake ports along an upper section adjacent to the pump with ports in a set vertically offset and sets horizontally offset; and an inner intake assembly having a separation chamber and a rotatable section communicable coupled with the reservoir chamber, wherein the rotatable section includes at least one communication port; wherein the inner intake assembly further comprises a divider having a first side and a second side having a guide, the separation chamber coupled too the first side and the rotatable section rotatable about the guide of the second side; and a port position controller that controls the position of the at least one communication port depending on the orientation of the gas separator;

wherein operation of the submersible pump causes reservoir liquid to flow through the at least one intake port and into the separation chamber through the at least one communication port.

16. The fluid separator of claim 15 wherein ports in a set are vertically offset and staggered.

17. The fluid separator of claim 15 wherein the rotatable section is positioned in the intake housing adjacent to the motor.

18. The fluid separator of claim 15 wherein the port position controller is a counterweight that functions to position the at least one communication port facing toward the bottom of the gas separator when the gas separator is positioned horizontally in a downhole reservoir.

19. The gas separator of claim 15 further comprising a shaft rotated by the motor.

20. The gas separator of claim 19 further comprising spider bearings keyed to the shaft.

* * * * *